US011111106B2

(12) United States Patent
Ebeling

(10) Patent No.: US 11,111,106 B2
(45) Date of Patent: Sep. 7, 2021

(54) SUSPENSION MEMBER EQUALIZATION SYSTEM FOR ELEVATORS

(71) Applicant: Tim Ebeling, Toledo, OH (US)

(72) Inventor: Tim Ebeling, Toledo, OH (US)

( * ) Notice: Subject to any disclaimer, the term of this patent is extended or adjusted under 35 U.S.C. 154(b) by 185 days.

(21) Appl. No.: 16/608,302

(22) PCT Filed: Apr. 20, 2018

(86) PCT No.: PCT/US2018/028487
§ 371 (c)(1),
(2) Date: Oct. 25, 2019

(87) PCT Pub. No.: WO2018/217344
PCT Pub. Date: Nov. 29, 2018

(65) Prior Publication Data

US 2020/0095093 A1 Mar. 26, 2020

Related U.S. Application Data

(60) Provisional application No. 62/511,593, filed on May 26, 2017.

(51) Int. Cl.
*B66B 7/10* (2006.01)
*B66B 7/08* (2006.01)

(52) U.S. Cl.
CPC . *B66B 7/10* (2013.01); *B66B 7/08* (2013.01)

(58) Field of Classification Search
CPC ..... B66B 7/10; B66B 7/08; B66B 7/1215; B66B 7/06; B66B 7/085; F16G 11/09; F16C 17/10; F16C 17/105
See application file for complete search history.

(56) References Cited

U.S. PATENT DOCUMENTS 1,323,357 A 12/1919 Evans
1,632,083 A * 6/1927 Kieckhefer ..... B66B 7/10 187/412

(Continued)

FOREIGN PATENT DOCUMENTS

CN 203439873 U * 2/2014
CN 203715028 U * 7/2014

(Continued)

*Primary Examiner* — Michael R Mansen
*Assistant Examiner* — Michelle M Lantrip
(74) *Attorney, Agent, or Firm* — Charles F. Charpie, III; Eastman & Smith Ltd.

(57) ABSTRACT

A suspension member equalization system is provided. The suspension member equalization system includes cylinder assemblies configured to receive rods extending from suspension member sockets. The cylinder assemblies have slidable pistons. A manifold block is in fluid communication with the cylinder assemblies. An incompressible fluid is in simultaneous communication with the cylinder assemblies and the manifold block. An upper swash plate is received within a cavity formed in a lower portion of each of the cylinder assemblies and in contact with the cylinder assemblies. A lower swash plate is received within an annular recess of each of the upper swash plates in a manner such that the upper swash plate is rotatable relative to the lower swash plate. The pistons within the cylinder assemblies are configured for movement such as to seek an approximately equal pressure, thereby approximating equal tension in each of the suspension members.

20 Claims, 7 Drawing Sheets

(56) References Cited

U.S. PATENT DOCUMENTS

| | | | | |
|---|---|---|---|---|
| 1,991,538 | A | 2/1935 | Beatty | |
| 2,001,007 | A | 5/1935 | Wilson | |
| 2,385,488 | A | 9/1945 | Beatty | |
| 3,157,032 | A | 11/1964 | Herpich | |
| 5,284,224 | A | 2/1994 | Carruth et al. | |
| 6,223,862 | B1 | 5/2001 | Barnes | |
| 6,341,669 | B1 * | 1/2002 | St. Pierre | B66B 7/08 187/412 |
| 8,225,909 | B2 | 7/2012 | Aulanko et al. | |
| 8,613,343 | B2 | 12/2013 | Aulanko et al. | |
| 9,156,655 | B2 * | 10/2015 | Cao | B66B 7/10 |
| 9,725,282 | B2 * | 8/2017 | Miller | B66B 7/062 |
| 10,138,931 | B2 * | 11/2018 | Kurose | F16C 33/74 |
| 2002/0095790 | A1 * | 7/2002 | Sasaki | F16C 23/045 29/898.06 |
| 2006/0175152 | A1 | 8/2006 | Fargo et al. | |
| 2006/0215944 | A1 * | 9/2006 | Watai | F16C 17/04 384/420 |
| 2006/0257059 | A1 * | 11/2006 | Kubota | F16C 33/103 384/293 |
| 2007/0151810 | A1 | 7/2007 | Aulanko et al. | |
| 2012/0132487 | A1 * | 5/2012 | Araki Yassuda | B66B 7/08 187/411 |
| 2013/0142462 | A1 * | 6/2013 | Morishige | F16C 33/74 384/130 |
| 2014/0185971 | A1 * | 7/2014 | Nagashima | F16C 17/045 384/291 |
| 2016/0152444 | A1 * | 6/2016 | Xu | B66B 7/10 187/412 |
| 2016/0207736 | A1 | 7/2016 | Zhu et al. | |
| 2017/0146056 | A1 * | 5/2017 | Morishige | F16C 17/04 |
| 2017/0217274 | A1 * | 8/2017 | Nagashima | F16C 35/02 |

FOREIGN PATENT DOCUMENTS

| | | | | | |
|---|---|---|---|---|---|
| CN | 105645221 | A | * | 6/2016 | |
| CN | 105752798 | A | * | 7/2016 | |
| CN | 106395556 | A | * | 2/2017 | |
| EP | 2336598 | A2 | * | 6/2011 | F21V 21/112 |
| ES | 1143983 | U | * | 9/2015 | B66B 7/10 |
| JP | 2012106863 | A | * | 6/2012 | B66B 7/10 |
| JP | 2017065923 | A | * | 4/2017 | |
| WO | WO-02070387 | A1 | * | 9/2002 | B66B 7/10 |
| WO | 2004063075 | A1 | | 7/2004 | |
| WO | 2005096719 | A2 | | 10/2005 | |
| WO | 2006120504 | A1 | | 11/2006 | |

* cited by examiner

SUSPENSION MEMBER EQUALIZATION SYSTEM FOR ELEVATORS

RELATED APPLICATIONS

This application claims the benefit of U.S. Provisional Application No. 62/511,593, filed May 26, 2017, the disclosure of which is incorporated herein by reference in its entirety.

BACKGROUND

Traction elevators use a plurality of suspension members to drive an elevator car in an upward and downward direction within opposing guide rails. The suspension members can have various forms, including the non-limiting examples of cables and belts. The suspension members can be driven by various devices including the non-limiting example of a sheaved traction machine.

A well-adjusted traction elevator includes suspension members having equal tension therebetween. Equal tension in the suspension members can extend the working life of the suspension members and the associated equipment, such as the drive sheave of the traction machine. It is known that an amount as little as 10% of unequal tension can reduce the lifetime of the set of suspension members by roughly 30%.

It would be advantageous if the respective tensions in the suspension members could be automatically adjusted as the elevator is operated.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the suspension member equalization system.

The above objects as well as other objects not specifically enumerated are achieved by a suspension member equalization system configured for use with a plurality of suspension members in an elevator system. The suspension member equalization system includes a plurality of cylinder assemblies, each configured to receive a rod extending from a suspension member socket. The suspension member socket is connected to a suspension member. Each of the plurality of cylinder assemblies has a slidable piston. A manifold block is in fluid communication with the plurality of cylinder assemblies. An incompressible fluid is in simultaneous communication with the plurality of cylinder assemblies and the manifold block. An upper swash plate is received within a cavity formed in a lower portion of each of the plurality of cylinder assemblies and in contact with each of the plurality of cylinder assemblies. A lower swash plate is received within an annular recess of each of the upper swash plates in a manner such that the upper swash plate is rotatable relative to the lower swash plate. The pistons within each of the plurality of cylinder assemblies are configured for movement such as to seek an approximately equal pressure, thereby approximating equal tension in each of the plurality of suspension members.

The above objects as well as other objects not specifically enumerated are also achieved by a method of using a suspension member equalization system for equalizing tension in a plurality of elevator suspension members. The method includes the steps of disposing each of a plurality of upper swash plates into each of a plurality of cavities formed within each of a plurality of cylinder assemblies, disposing each of a plurality of lower swash plates into portions of each of the plurality of upper swash plates in a manner such that each of the plurality of upper swash plates and each of the plurality of lower swash plates are rotatable relative to each other, extending each of a plurality of rods through each of the plurality of cylinder assemblies, through each of the plurality of upper swash plates and through each of the plurality of lower swash plates, each of the plurality of rods extending from each of a plurality of suspension member sockets, each of the suspension member sockets connected to each of a plurality of suspension members, each of the plurality of cylinder assemblies having a slidable piston, fluidly connecting a manifold block to each of the plurality of cylinder assemblies with an incompressible fluid, providing tension in the plurality of suspension members and allowing the sliding pistons to seek an approximately equal pressure, thereby approximating equal tension in each of the plurality of suspension members.

Various aspects of the suspension member equalization system will become apparent to those skilled in the art from the following detailed description of the illustrated embodiments, when read in light of the accompanying drawings.

DETAILED DESCRIPTION OF THE INVENTION

The suspension member equalization system for elevators will now be described with occasional reference to the specific embodiments. The suspension member equalization system may, however, be embodied in different forms and should not be construed as limited to the embodiments set forth herein. Rather, these embodiments are provided so that this disclosure will be thorough and complete, and will fully convey the scope of the suspension member equalization system to those skilled in the art.

Unless otherwise defined, all technical and scientific terms used herein have the same meaning as commonly understood by one of ordinary skill in the art to which the suspension member equalization system belongs. The terminology used in the description of the suspension member equalization system herein is for describing particular embodiments only and is not intended to be limiting of the suspension member equalization system. As used in the description of the apparatus and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the suspension member equalization system. Notwithstanding that the numerical ranges and parameters setting forth the broad scope of the suspension member equalization system are approximations, the numerical values set forth in the specific examples are reported as precisely as possible. Any numerical values, however, inherently contain certain errors necessarily resulting from error found in their respective measurements.

In accordance with the illustrated embodiments, a suspension member equalization system is provided. Generally, the suspension member equalization system is configured to sense the load incurred by each suspension member. The suspension member equalization system is further configured to adjust the tension in each suspension member to be approximately equal to the tension experienced by the other suspension members. The hydraulic rope equalization system includes cylinder assemblies provided to each suspension member and a common manifold block. The cylinder assemblies and the manifold block are in simultaneous fluid communication with each other. With the suspension members under tension from a load within the elevator car, pistons disposed within the cylinder assemblies are slidable and move to seek an approximately equal pressure, thereby approximating equal tension in each of the plurality of suspension members.

Figure 1:
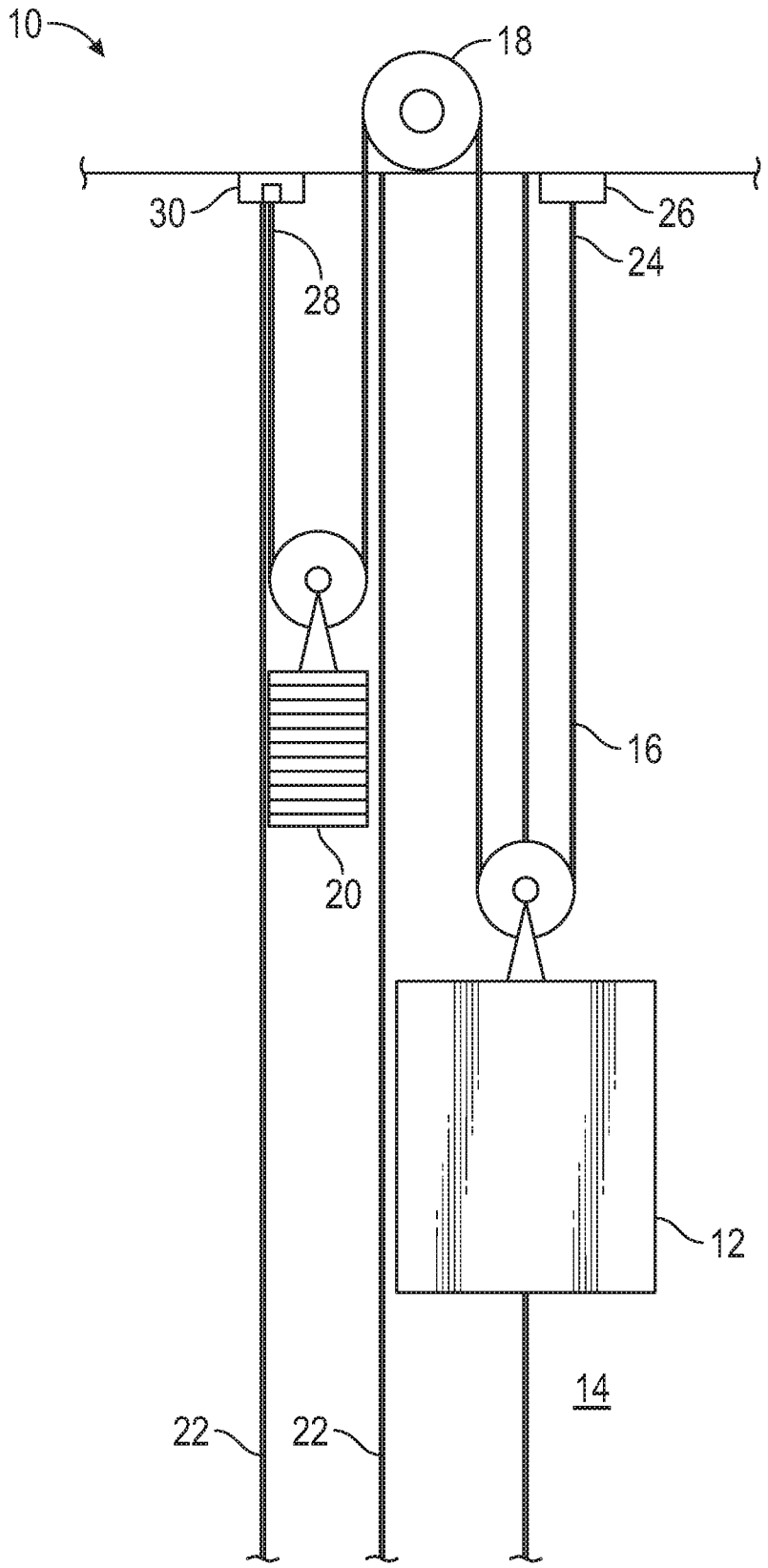
FIG. 1 is a side view of portions of an elevator system including a first and second elevator fixture.

Referring now to the drawings, there is illustrated in FIG. 1 a diagrammatic and simplified view of a traction elevator 10 (hereafter "elevator"). The elevator 10 includes an elevator car 12, configured to move in a substantially vertical direction on opposing car guide rails (not shown for purposes of simplicity). The elevator car 12 and the car guide rails are disposed in an elevator hoistway 14. The hoistway 14 can be defined by hoistway walls or by other structures, assemblies and components, such as the non-limiting example of structural divider beams and the like. The elevator car 12 is supported by a first segment of a plurality of suspension members 16, which are moved with an elevator machine 18. The suspension members 16 may consist of multiple ropes, flat belts or other suitable structures.

Referring again to FIG. 1, a second segment of the one or more suspension members 16 is configured to support a counterweight assembly 20. The counterweight assembly 20 is configured to balance a portion of the weight of the elevator car 12 and the rated capacity of the elevator car 12. The counterweight assembly 20 moves in a substantially vertical direction on opposing counterweight guide rails 22.

Referring again to FIG. 1, the hoistway 14 can be divided vertically into building floors (not shown). The building floors can have entrances (not shown) configured to facilitate ingress into and egress out of the elevator car 12.

Referring again to FIG. 1, a first end 24 of the suspension members 16 can be fixed to a first fixture 26. In a similar manner, a second end 28 of the suspension members 16 can be fixed to a second fixture 30.

While the structures of the first and second fixtures 26, 30 illustrated in FIG. 1 are described in relation to a traction elevator 10 having a 2:1 suspension system, it should be appreciated that the first and second fixtures 26, 30 can be incorporated into traction elevators having other suspension systems, including the non-limiting examples of 1:1, 4:1, 6:1 and underslung suspension systems.

Figure 2:
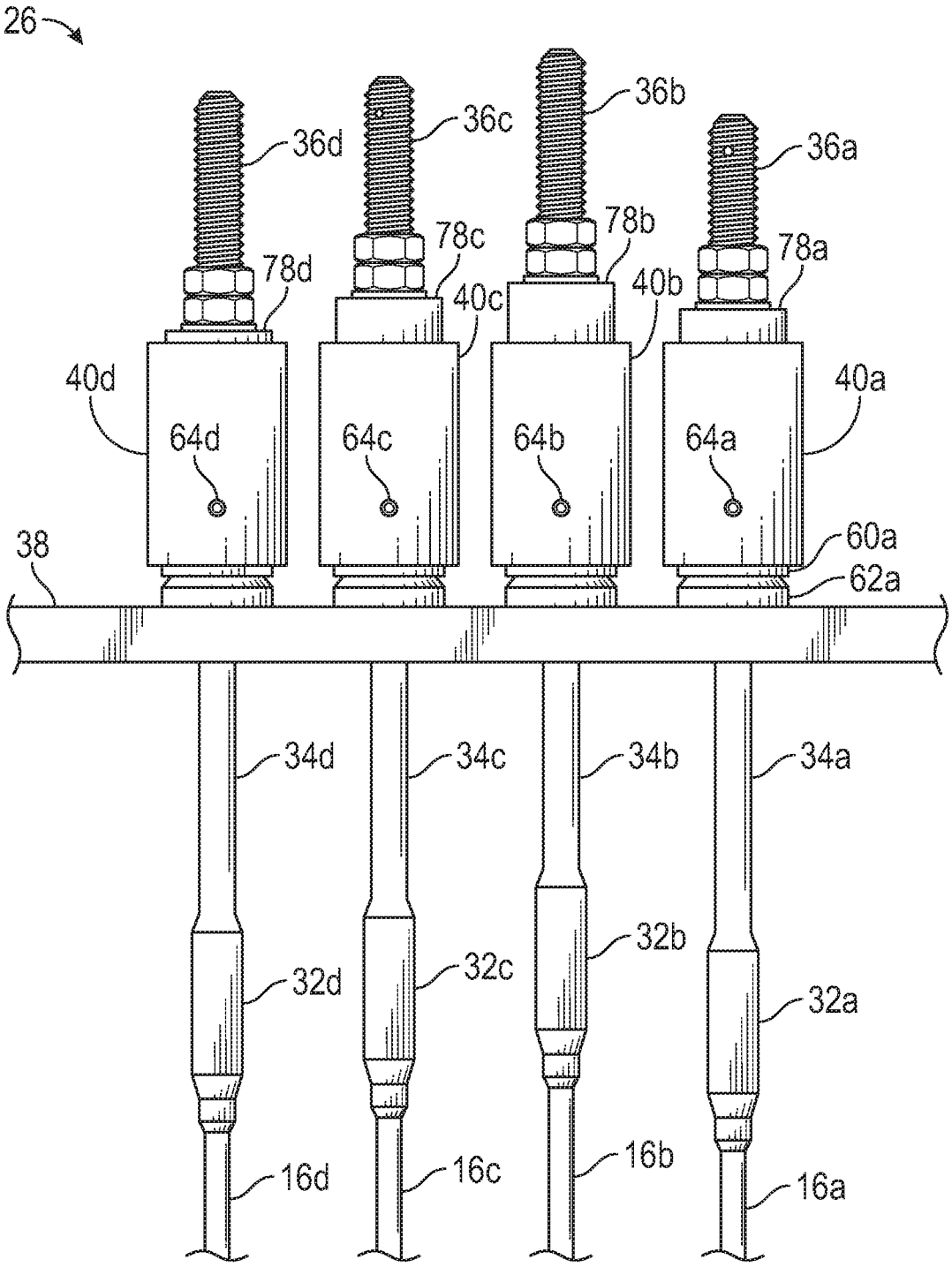
FIG. 2 is a side view, in elevation, of a first fixture of the elevator system of FIG. 1 illustrating a plurality of cylinder assemblies.

Referring now to FIG. 2, the first fixture 26 is illustrated. The first fixture 26 can be illustrative of the second fixture 30. A plurality of suspension members 16*a*-16*d* are illustrated. Each suspension members 16*a*-16*d* is attached to a suspension member socket 32*a*-32*d*. The suspension member sockets 32*a*-32*d* are known in the art. The suspension member sockets 32*a*-32*d* include rods 34*a*-34*d* having threaded ends 36*a*-36*d*. The rods 34*a*-34*d* are configured to extend through a mounting plate 38. The mounting plate 38 is designed for minimal deflection and may be fixed to any suitable structural members, including the non-limiting examples of a car or counterweight guide rail, machine beam, hoistway wall, sufficient to support the weight of the car 12. However, in other embodiments, the mounting plate 38 may be eliminated and the suspension member terminations can be attached directly to the other suitable structures.

Referring again to FIG. 2, the first fixture 26 includes a plurality of cylinder assemblies 40*a*-40*d*. Each of the cylinder assemblies 40*a*-40*d* is axially aligned with the respective rod 34*a*-34*d*.

Figure 3:
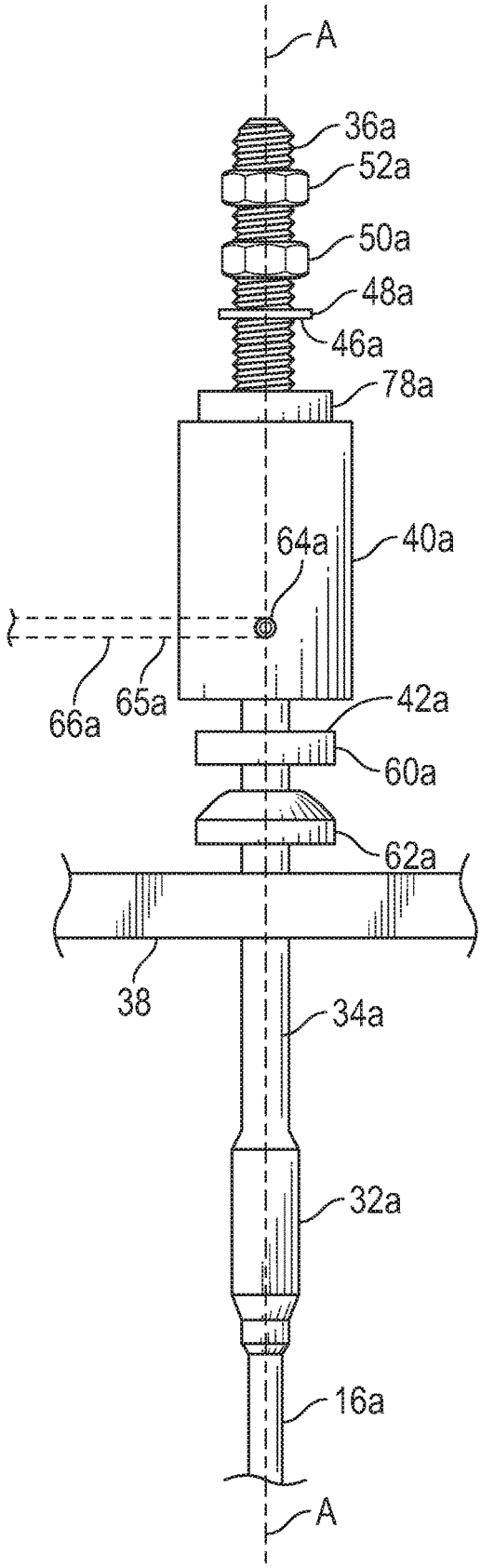
FIG. 3 is an exploded perspective view of the first fixture of FIG. 2.

Referring now to FIG. 3, the suspension member 16*a*, suspension member socket 32*a*, rod 34*a*, threaded end 36*a* and cylinder assembly 40*a* are illustrated and are representative of the suspension members 16*b*-16*d*, suspension member socket 32*b*-32*d*, rods 34*b*-34*d*, threaded ends 36*b*-36*d* and cylinder assemblies 40*b*-40*d*. The suspension member 16*a*, suspension member socket 32*a*, rod 34*a*, threaded end 36*a* are longitudinally aligned along Axis A-A. As will be explained in more detail below, the cylinder assembly 40*a* is configured to receive the threaded end 36*a* of the rod 34*a* such that the threaded end 36*a* passes therethrough and the cylinder assembly 40*a* is also axially aligned with Axis A-A.

Referring again to FIG. 3, the cylinder assembly 40*a* is secured in place between an upper surface 42*a* of an upper swash plate 60*a* and a lower surface 46*a* of an upper washer 48*a* by a first nut 50*a*, a lock nut 52*a* and cotter pin (not shown). The cylinder assembly 40*a* is configured to exert an axial force on the rod 34*a*.

Referring again to FIG. 3, a lower swash plate 62*a* is positioned between the upper swash plate 60*a* and the mounting plate 38. The cylinder assembly 40*a*, upper swash plate 60*a* and lower swash plate 62*a* each have annular shapes and respective apertures, thereby allowing the rod 34*a* to pass therethrough.

Referring again to FIG. 3, a portion of the weight of the elevator car 12 and the rated capacity of the elevator car 12 is borne by the suspension member 16*a*. The portion of the weight of the elevator car 12 and the rated capacity of the elevator car 12 is sensed by the cylinder assembly 40*a*, which is compressed in proportion to the load.

Referring again to FIG. 3, the cylinder assembly 40*a* includes a cylinder port 64*a*. A first end 65*a* of a first conduit, shown schematically at 66*a*, is connected to the cylinder port 64*a*. The cylinder port 64*a* is configured for one-way fluid communication from the conduit 66*a* into an internal cavity 76*a*. In the illustrated embodiment, the cylinder port 64*a* has the form of a ball valve. However, in other embodiments, the cylinder port 64*a* can have other forms sufficient for one-way fluid communication from the conduit 66*a* into an internal cavity 76*a*. The first conduit 66*a* is configured for passage of a fluid therewithin.

Figure 4:
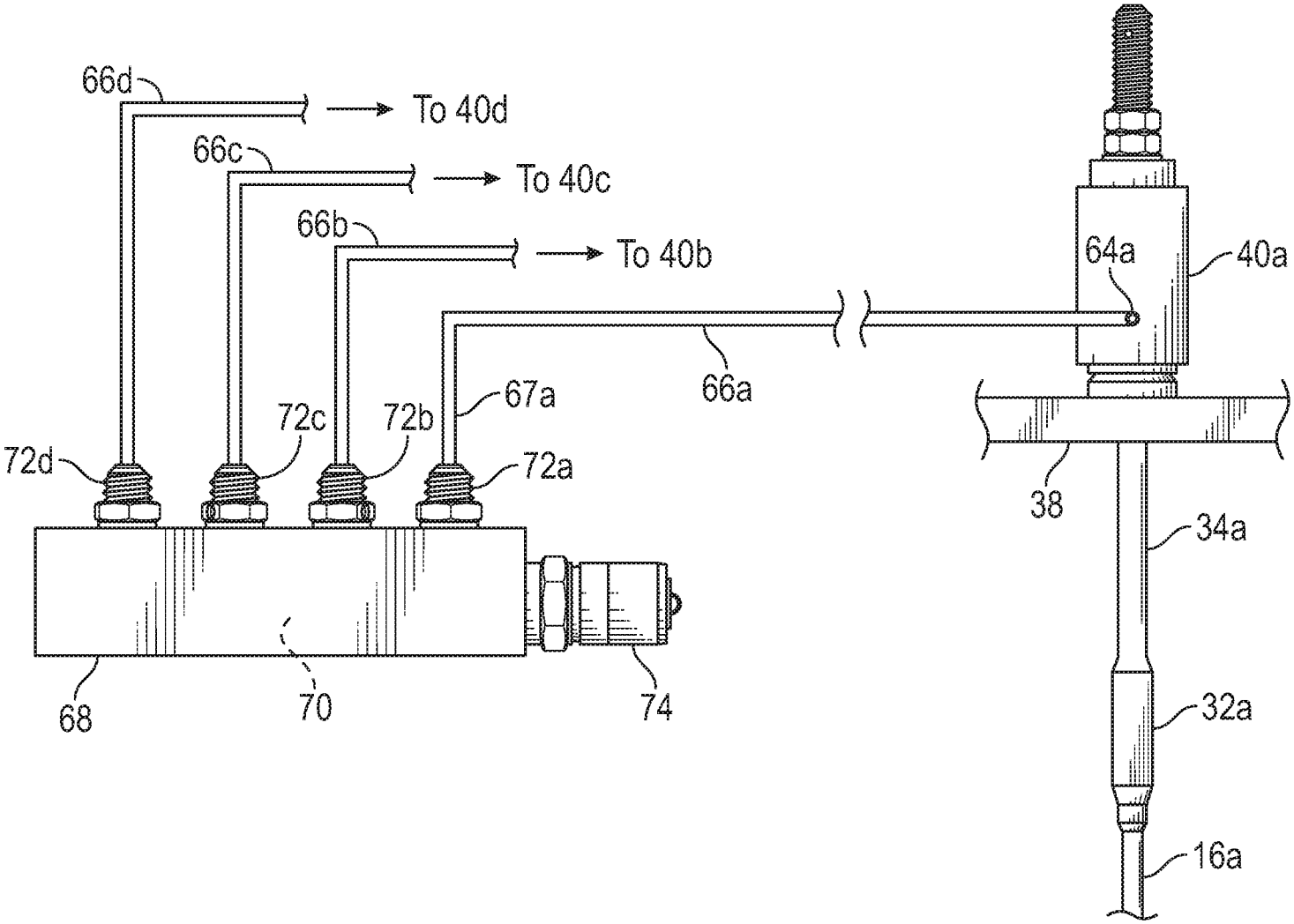
FIG. 4 is a side view of a manifold block of the elevator system of FIG. 1 illustrating fluid connection to a cylinder assembly.

Referring now to FIG. 4, a manifold block 68 is illustrated. The manifold block 68 includes a plurality of outer walls configured to define a manifold cavity 70 therewithin. The manifold block 68 includes a first manifold port 72*a*, a second manifold port 72*b*, a third manifold port 72*c* and a fourth manifold port 72*d*. A second end 67*a* of the first conduit 66*a* is connected to the first manifold port 72*a* in a manner such that the first conduit 66*a* is in fluid communication with the manifold cavity 70.

Referring again to FIG. 4, a second conduit 66*b* extends from the cylinder port 64*b* of the cylinder assembly 40*b* to the second manifold port 72*b*, a third conduit 66*c* extends from the cylinder port 64*c* of the cylinder assembly 40*c* to the third manifold port 72*c* and a fourth conduit 66*d* extends from the cylinder port 64*d* of the cylinder assembly 40*d* to the fourth manifold port 72*d*. The ports 64*a*-64*d*, 72*a*-72*d* and conduits 66*a*-66*d* are configured such as to allow simultaneous fluid communication between the cylinder assemblies 40*a*-40*d* and the manifold cavity 70.

Referring again to FIG. 4, a connector port 74 is attached to the manifold block 68 and configured to facilitate fluid communication between the manifold cavity 70 and an outside source (not shown). As will be explained in more detail below, the connector port 74 is used to supply an incompressible fluid to the manifold block 68, conduits 66*a*-66*d* and the cylinder assemblies 40*a*-40*d*.

Figure 5B:
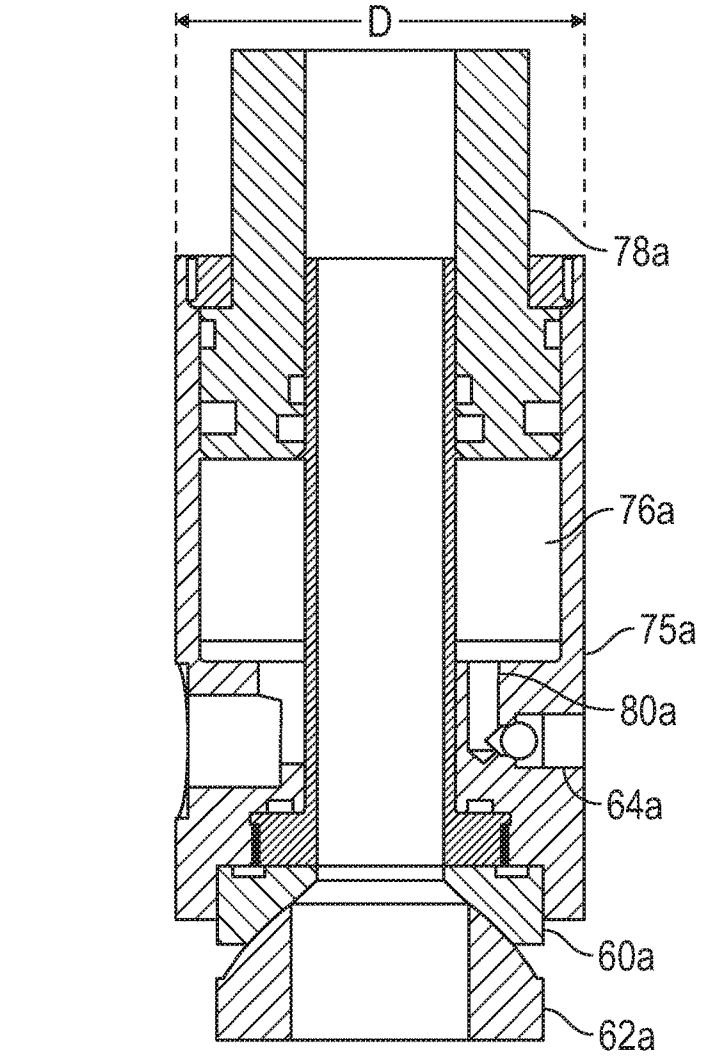
FIG. 5B is a cross-sectional view, in elevation, of the cylinder assembly of FIG. 2.
Figure 5A:
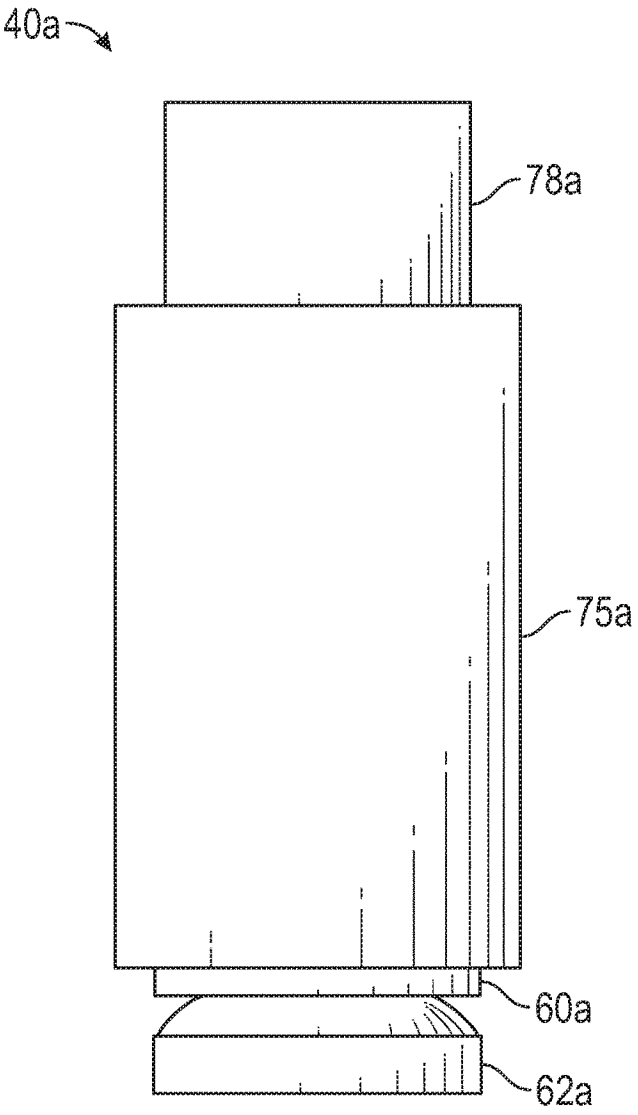
FIG. 5A is a front view, in elevation, of the cylinder assembly of FIG. 2.

Referring now to FIGS. 5A and 5B, the cylinder assembly 40*a* is illustrated. The cylinder assembly 40*a* is in contact with the upper swash plate 60*a* and the upper swash plate 60*a* is seated against the lower swash plate 62*a*. The cylinder assembly 40*a* includes a housing 75*a* configured to define the internal cavity 76*a*. A piston 78*a* is mounted for slidable axial movement within the internal cavity 76*a*. The housing 75*a* is configured to support the cylinder port 64*a* and an internal passage 80*a* providing fluid communication between the cylinder port 64 and the internal cavity 76*a*. As will be explained in more detail below, the internal cavity 76*a* is configured to receive fluids from the internal passage 80*a*.

Referring now to FIG. 5B, the housing 75*a* has a circular cross-sectional shape and a diameter D. The diameter D is configured such that the cylinder assemblies 40*a*-40*d* can fit between the suspension member sockets 32*a*-32*d* without interference between adjacent suspension member sockets 32*a*-32*d*. In the illustrated embodiment, the diameter D is in a range of from about 2.0 inches (5.08 cm) to about 4.0 inches (10.15 cm). However, in other embodiments, the housing 75*a* can have other cross-sectional shapes and the diameter D can be less than about 2.0 inches (5.08 cm) or more than about 4.0 inches (10.15 cm), sufficient that the cylinder assemblies 40*a*-40*d* can fit between the suspension member sockets 32*a*-32*d* without interference between adjacent suspension member sockets 32*a*-32*d*.

Referring now to FIGS. 2, 4 and 5B, in operation, a conduit 66*a*-66*d* is connected to each of the cylinder assemblies 40*a*-40*d* and the manifold ports 72*a*-72*d* in a manner such as to allow fluid communication between the cylinder assemblies 40*a*-40*d* and the manifold cavity 70. The connector port 74 is also attached to the manifold block 68. In a next step, the connector port 74 is connected to an outside source of incompressible fluid and the incompressible fluid is supplied to the manifold cavity 70, conduits 66*a*-66*d* and to the internal cavities 76*a*-76*d* of the cylinder assemblies 40*a*-40*d* in a manner such as to fill the manifold cavity 70, conduits 66*a*-66*d* and to the internal cavities 76*a*-76*d*. In the illustrated embodiment, the incompressible fluid is hydraulic fluid. However, in other embodiments, the incompressible fluid can be other fluids. In an optional next step, the system comprising the internal cavities 76*a*-76*d* of the cylinder assemblies 40*a*-40*d*, conduits 66*a*-66*d* and the manifold cavity 70 of the manifold block 68 can be "bled" to remove air trapped with the incompressible fluid.

Referring again to FIGS. 2, 4 and 5B, since all of the incompressible fluid-containing structures, namely the internal cavities 76*a*-76*d* of the cylinder assemblies 40*a*-40*d*, conduits 66*a*-66*d* and the manifold cavity 70 of the manifold block 68 are simultaneous in fluid communication, the pistons 78*a*-78*d* within each of the cylinder assemblies 40*a*-40*d* will seek an approximately equal pressure and approximate equal tension in each of the suspension members 16*a*-16*d*. The equaling of the pressures within the cylinder assemblies 40*a*-40*d* and equalization of the tension in each of the suspension members 16*a*-16*d* can result in the pistons 78*a*-78*d* extending in uneven distances beyond the housings 75*a*-75*d*, as is clearly shown in FIG. 2. Without being held to the theory, it is believed the oil-containing structures, namely the internal cavities 76*a*-76*d* of the cylinder assemblies 40*a*-40*d*, conduits 66*a*-66*d* and the manifold cavity 70 of the manifold block 68 operate on the principle of "communicating vessels", thereby allowing the tension in the suspension members 16*a*-16*d* to equalize at any time and not just during non-use of the elevator. The first nuts 50*a* can be tighten to maintain the pistons 78*a* in their relative positions.

Figure 6:
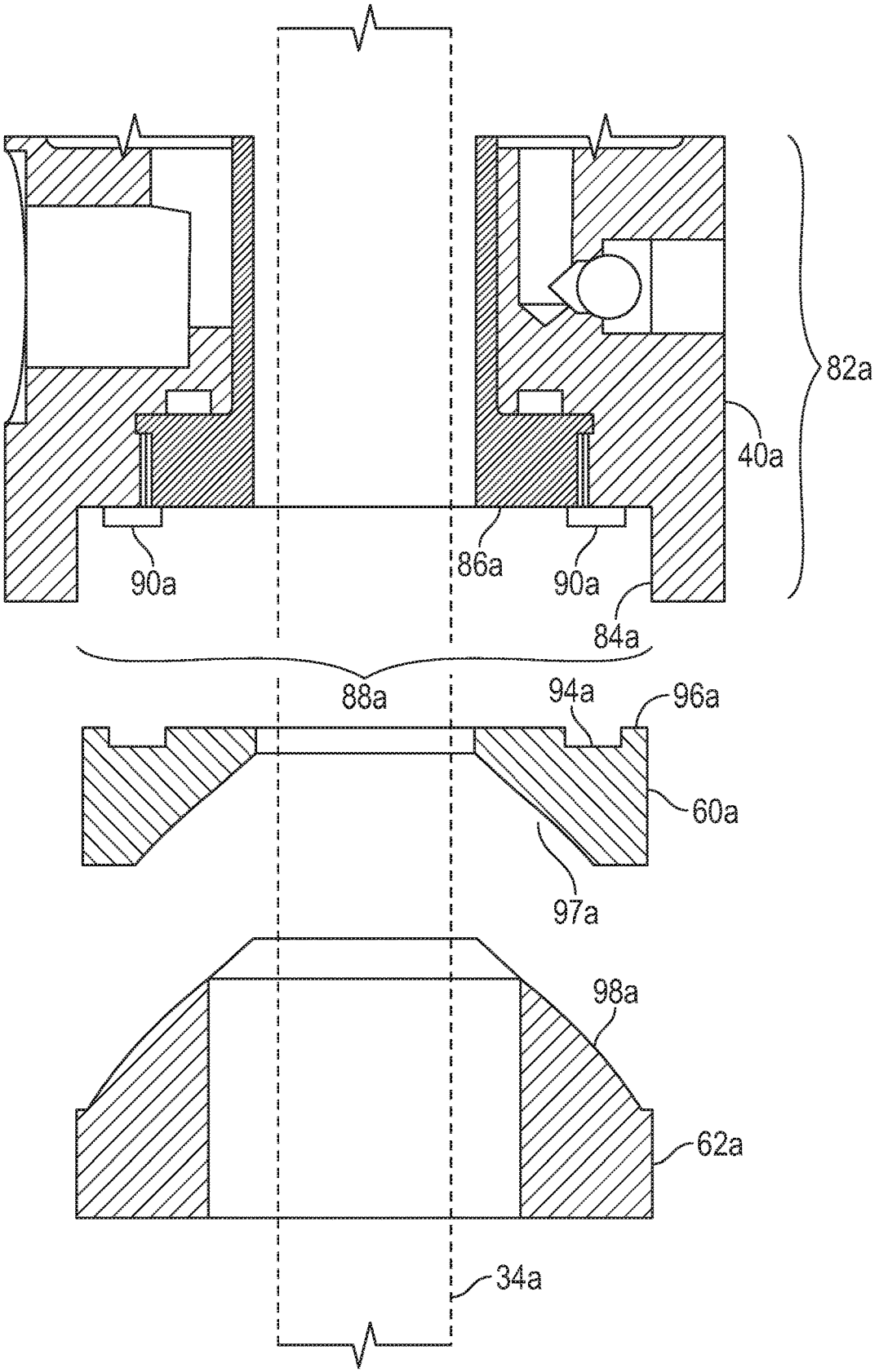
FIG. 6 is an enlarged, cross-sectional view of a lower portion of the cylinder assembly of FIG. 2 shown in relation to an upper and lower swash plate.
Figure 7:
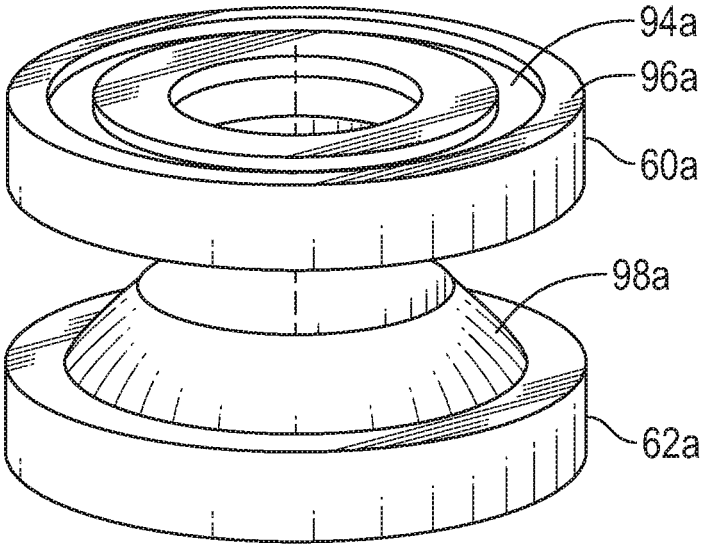
FIG. 7 is a top perspective view of the upper and lower swash plates of FIG. 6.
Figure 8:
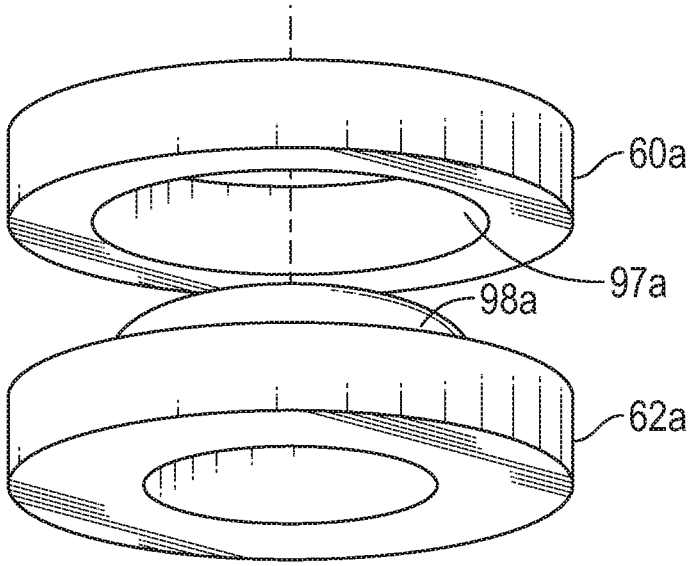
FIG. 8 is a bottom perspective view of the upper and lower swash plates of FIG. 6.

Referring now to FIGS. 6-8, a lower portion 82*a* of the cylinder assembly 40*a* is illustrated along with the upper swash plate 60*a* and lower swash plate 62*a*. The cylinder assembly 40*a* includes an internal circumferential wall 84*a* and a partition 86*a*. The internal circumferential wall 84*a* and the partition 86*a* cooperate to form a cavity 88*a*. A plurality of spaced-apart projections 90*a* extend from the partition 86*a* of the cylinder assembly 40*a*. The projections 90*a* extend in a direction toward the upper swash plate 60*a*. In the illustrated embodiment, a quantity of three (3) projections 90*a* are spaced-apart on a consistent radius by equal 120° angles. The consistent radius of the equally spaced-apart projections 90*a* is configured to define a location for the introduction of force into the cylinder assembly 40*a*. That is, the cylinder assembly 40*a* receives the compressive force at defined locations of the partition 86*a*. Without being held to the theory, it is believed the defined location of the introduction of force into the cylinder assembly 40*a* contributes to the reliable and repeatable operation of the cylinder assembly 40*a*. However, in other embodiments, more or less than three (3) projections 90*a* can be used and the projections 90*a* can be spaced apart by other angles sufficient to define a location for the introduction of force into the cylinder assembly 40*a*.

Referring again to FIGS. 6-8, the upper swash plate 60*a* includes an annular race 94*a* located at an upper surface 96*a* of the upper swash plate 60*a*. With the upper swash plate 60*a* in a seated arrangement within the cavity 88*a* of the cylinder assembly 40*a*, the upper surface 96*a* of the upper swash plate 60*a* is seated against the partition 86*a* of the cylinder assembly 40*a* and the plurality of projections 90*a* extending from the partition 86*a* of the cylinder assembly 40*a* are received by the annular race 94*a* in the upper swash plate 60*a*. In this manner, the upper swash plate 60*a* is radially centered about the cylinder assembly 40*a*. When seated in the race 94*a*, the plurality of projections 90*a* prevent radial sliding of the cylinder assembly 40*a* relative to the upper swash plate 60*a*. Without being held to the theory, it is believed the structure of the seated projections 90*a* within the race 94*a* contributes to the location of the defined force introduction of the cylinder assembly 40*a*, which thereby contributes to the accurate, reliable and repeatable operation of the cylinder assembly 40*a*.

Referring again to FIGS. 6-8, each of the projections 90*a* has the form of cubes or squares. However, in other embodiments, the projections 90*a* can have other forms, such as the non-limiting example of a circular structure, sufficient to be received in the race 94*a* of the upper swash plate 60*a* and contribute to the location of the defined force introduction of the cylinder assembly 40*a*. It is also within the contemplation of the suspension member equalization system that the projections 90*a* can have differing shapes relative to each other.

Referring again to FIGS. 6-8, the upper swash plate 60*a* includes an annular recess 97*a* configured to receive a mating annular projection 98*a* extending from the lower swash plate 62*a*. With the upper swash plate 60*a* and the lower swash plate in a nested position, the annular projection 98*a* is in sliding contact with the annular recess 97*a* of the upper swash plate 60*a*. The recess 97*a* of the upper swash plate 60*a* and the projection 98*a* are configured for several functions. First, the recess 97*a* of the upper swash plate 60*a* and the projection 98*a* are configured such that upper swash plate 60*a* and the lower swash plate 62*a* can rotate relative to each other in a manner such as to compensate for misalignment of the mounting plate 38 and the rod 34*a* extending upward through the mounting plate 38. Second, since the recess 97*a* of the upper swash plate 60*a* and the projection 98*a* are configured to rotate relative to each other, the upper swash plate 60*a* and the lower swash plate 62*a* cooperate with each other to contribute to the location of the defined force introduction of the cylinder assembly 40*a*.

Referring again to FIGS. 6-8, the annular recess 97*a* has the form of a hollow socket and the annular projection 98*a* has the form of a hollow dome. However, in other embodiments, the annular recess 97*a* and the annular projection 98*a* can have other mating forms sufficient for the functions described herein.

Referring again to FIG. 5B, in a nested arrangement, the swash plates 60*a*, 62*a* cooperate with the lower portion 82*a* of the cylinder assembly 40*a* to provide several unexpected benefits. First, the nested swash plates 60*a*, 62*a* align the cylinder assembly 40*a* such as to be substantially parallel to the rod 34*a* (shown in phantom for purposes of clarity), even in the circumstance that the rod 34*a* is arranged at an inclined orientation relative to the mounting plate 38. Without be held to the theory, it is believed that if the swash plates 60*a*, 62*a* did not align the cylinder assembly 40*a* such as to be substantially parallel the rod 34*a*, then a portion of the tension in the suspension member would act orthogonally on the cylinder assembly 40*a*, thereby resulting in destruction of the cylinder assembly 40*a* or the need to use a cylinder assembly 40*a* having a much larger diameter D. Second, the nested swash plates 60*a*, 62*a* provide a defined force introduction location into the cylinder assembly 40*a*. That is, the cylinder assembly 40*a* receives the compressive force of the upper swash plate 60*a* at the defined location of the partition 86*a*. Without being held to the theory, it is believed the defined force introduction location provides several benefits. First, the defined force introduction location contributes to the reliable and repeatable operation of the cylinder assembly 40*a*. Second, the defined force introduction location allows the cylinder assembly 40*a* to be small in diameter, thereby allowing the cylinder assemblies 40*a*-40*d* to be permanently mounted in the installation. Finally, the tension in the suspension members 16*a*-16*d* equalizes at all times and not just during non-use of the elevator.

The principle and mode of operation of the suspension member equalization system for elevators have been described in certain embodiments. However, it should be noted that the suspension member equalization system for elevators may be practiced otherwise than as specifically illustrated and described without departing from its scope.

What is claimed is:

1. A suspension member equalization system configured for use with a plurality of suspension members in an elevator system, the suspension member equalization system comprising:

a plurality of cylinder assemblies, each configured to receive a rod extending from a suspension member socket, the suspension member socket connected to a suspension member, each of the plurality of cylinder assemblies having a slidable piston;

a manifold block in fluid communication with the plurality of cylinder assemblies, an incompressible fluid in simultaneous communication with the plurality of cylinder assemblies and the manifold block;

an upper swash plate received within a cavity formed in a lower portion of each of the plurality of cylinder assemblies and in contact with each of the plurality of cylinder assemblies; and a lower swash plate received within an annular recess of each of the upper swash plates in a manner such that the upper swash plate is rotatable relative to the lower swash plate;

wherein the pistons within each of the plurality of cylinder assemblies are configured for movement such as to seek an approximately equal pressure, thereby approximating equal tension in each of the plurality of suspension members.

2. The suspension member equalization system of claim 1, wherein each of the cylinder assemblies includes an cylinder port configured to connect a conduit with the manifold block.

3. The suspension member equalization system of claim 2, wherein each of the cylinder ports are in fluid communication with an internal passage fluidly connected to an internal cavity configured to receive the slidable piston.

4. The suspension member equalization system of claim 1, wherein each of the cylinder assemblies is radially centered about the rod.

5. The suspension member equalization system of claim 1, wherein a plurality of spaced apart projections extend outwardly from a lower partition of each of the cylinder assemblies, the projections configured to define a location for the introduction of force into the cylinder assemblies.

6. The suspension member equalization system of claim 5, wherein the projections have the form of a cube.

7. The suspension member equalization system of claim 5, wherein the projections are spaced-apart on a consistent radius by equal 120° angles.

8. The suspension member equalization system of claim 5, wherein the projections are received by a race disposed in the upper swash plate.

9. The suspension member equalization system of claim 8, wherein the race in the upper swash plate is configured to prevent sliding of the cylinder assembly in a radial direction.

10. The suspension member equalization system of claim 8, wherein the lower swash plate is configured to receive the rod extending therethrough and further configured to seat against a mounting plate.

11. The suspension member equalization system of claim 8, wherein the upper swash plate includes a hollow socket.

12. The suspension member equalization system of claim 10, wherein the cylinder assembly has a diameter in a range of from about 2.0 inches (5.08 cm) to about 4.0 inches (10.15 cm).

13. The suspension member equalization system of claim 10, wherein the incompressible fluid is hydraulic fluid.

14. The suspension member equalization system of claim 1, wherein the manifold block includes a plurality of manifold ports, wherein each of the manifold ports is configured to be in fluid communication with a conduit extending to a cylinder assembly.

15. The suspension member equalization system of claim 1, wherein the manifold block includes a manifold cavity, configured to store incompressible fluid.

16. The suspension member equalization system of claim 15, wherein the manifold block includes a connector port configured for fluid communication with the manifold cavity.

17. A method of using a suspension member equalization system for equalizing tension in a plurality of elevator suspension members, the method comprising the steps of:

disposing each of a plurality of upper swash plates into each of a plurality of cavities formed within each of a plurality of cylinder assemblies;

disposing each of a plurality of lower swash plates into portions of each of the plurality of upper swash plates in a manner such that each of the plurality of upper swash plates and each of the plurality of lower swash plates are rotatable relative to each other;

extending each of a plurality of rods through each of the plurality of cylinder assemblies, through each of the plurality of upper swash plates and through each of the plurality of lower swash plates, each of the plurality of rods extending from each of a plurality of suspension member sockets, each of the suspension member sockets connected to each of a plurality of suspension members, each of the plurality of cylinder assemblies having a slidable piston;

fluidly connecting a manifold block to each of the plurality of cylinder assemblies with an incompressible fluid; and providing tension in the plurality of suspension members and allowing the sliding pistons to seek an approximately equal pressure, thereby approximating equal tension in each of the plurality of suspension members.

18. The method of claim 17, wherein each of the cylinder assemblies is radially centered about each of the plurality of rods.

19. The method of claim 17, wherein a plurality of spaced apart projections extend outwardly from a lower partition of each of the cylinder assemblies, the plurality of projections configured to define a location for the introduction of force into the cylinder assemblies.

20. The method of claim 19, wherein the plurality of projections are received by a race disposed in the upper swash plate.

* * * * *